US010039385B2

(12) United States Patent
Shih

(10) Patent No.: US 10,039,385 B2
(45) Date of Patent: Aug. 7, 2018

(54) ELECTRIC BED

(71) Applicant: Chuan-Hang Shih, Changhua County (TW)

(72) Inventor: Chuan-Hang Shih, Changhua County (TW)

( * ) Notice: Subject to any disclaimer, the term of this patent is extended or adjusted under 35 U.S.C. 154(b) by 76 days.

(21) Appl. No.: 15/258,257

(22) Filed: Sep. 7, 2016

(65) Prior Publication Data

US 2018/0064260 A1 Mar. 8, 2018

(51) Int. Cl.

*A47C 17/86* (2006.01)
*A47C 17/16* (2006.01)
*A47C 20/04* (2006.01)

(52) U.S. Cl.

CPC ..... *A47C 17/86* (2013.01); *A47C 17/16* (2013.01); *A47C 20/041* (2013.01)

(58) Field of Classification Search

CPC ..... A61G 7/015; A47C 17/086
See application file for complete search history.

(56) References Cited

U.S. PATENT DOCUMENTS 1,771,231 A * 7/1930 Parkinson ..... A47C 7/70 108/38
1,907,322 A * 5/1933 Keicher ..... A47C 7/70 108/33
2,502,383 A * 3/1950 Loewy ..... A47C 7/70 297/145
3,972,560 A * 8/1976 White ..... A47B 83/02 108/40
4,847,929 A * 7/1989 Pupovic ..... A61G 7/008 5/604
5,217,277 A * 6/1993 Rasnick ..... A47B 43/02 297/145
5,251,956 A * 10/1993 Hofmeyer ..... A47C 1/143 297/144
2001/0032362 A1* 10/2001 Welling ..... A61G 7/00 5/600
2009/0013470 A1* 1/2009 Richards ..... A61G 7/05715 5/613
2011/0012393 A1* 1/2011 Kanthasamy ..... A47B 83/02 297/173
2013/0249256 A1* 9/2013 Payne, Jr. ..... A47C 7/50 297/161
2013/0340167 A1* 12/2013 Karwal ..... A61G 7/005 5/611
2014/0245933 A1* 9/2014 Leslie ..... A47C 17/86 108/50.11
2016/0022518 A1* 1/2016 Shih ..... A61G 7/018 5/616
2016/0331612 A1* 11/2016 Clenet ..... A61G 7/015
2017/0208953 A1* 7/2017 Shih ..... A47C 17/16

* cited by examiner

*Primary Examiner* — Eric J Kurilla
(74) *Attorney, Agent, or Firm* — Muncy, Geissler, Olds & Lowe, P.C.

(57) ABSTRACT

An electric bed includes a frame, an actuator, a base body and a plate member. The frame includes a fixed rack and a movable rack movably disposed at the fixed rack. The actuator is disposed between the fixed rack and the movable rack in a way that the movable rack is movable relative to the fixed rack. The base body is disposed at a top side of the frame. The plate member is movable into and out of the base body. As a result, the plate member can be used as a table or a supporting frame for replacing things thereon, and the plate member can move back when user do not want to use the plate member.

9 Claims, 5 Drawing Sheets

ELECTRIC BED

BACKGROUND OF THE INVENTION

1. Field of the Invention

The present invention relates generally to beds and more particularly, to an electric bed.

2. Description of the Related Art

When compared with a traditional bed having a stationary frame, an electric bed has a frame which can lift a specific body portion, such as shanks, thighs, or back, etc. by user, so that the user can change a reclining posture freely, and the comfortableness would be enhanced. Accordingly, most users like to read books, watch TV, eat, or use smart phone or tablet on the electric bed. However, if these things such as book, remote controller, plate, and smart phone are left on the bed during or after being used by users, the users may feel uncomfortable during rest or the bed is unclean. Therefore, users need to purchase a nightstand or place a table or a chair beside the bed to place the things. However, these nightstand, table and chair occupy space. Accordingly, current design of electric bed has no place for placing the things except on the lying area of the bed.

SUMMARY OF THE INVENTION

The present invention has been accomplished in view of the above-noted circumstances. It is an objective of the present invention to provide an electric bed, so that users can place things on the electric bed with convenience.

To attain the above objective, the present invention provides an electric bed including a frame, an actuator, a base body and a plate member. The frame includes a fixed rack and a movable rack movably disposed at the fixed rack. The actuator is disposed between the fixed rack and the movable rack in a way that the movable rack is movable relative to the fixed rack. The base body is disposed at a top side of the frame. The plate member is movable into and out of the base body.

Accordingly, when user wants to place things, he/she can pull out the plate member to be used as a table or a supporting frame for placing the things thereon. In addition, if the user do not want to use the plate member, the plate member can be pushed back.

DETAILED DESCRIPTION OF THE INVENTION

Figure 1:
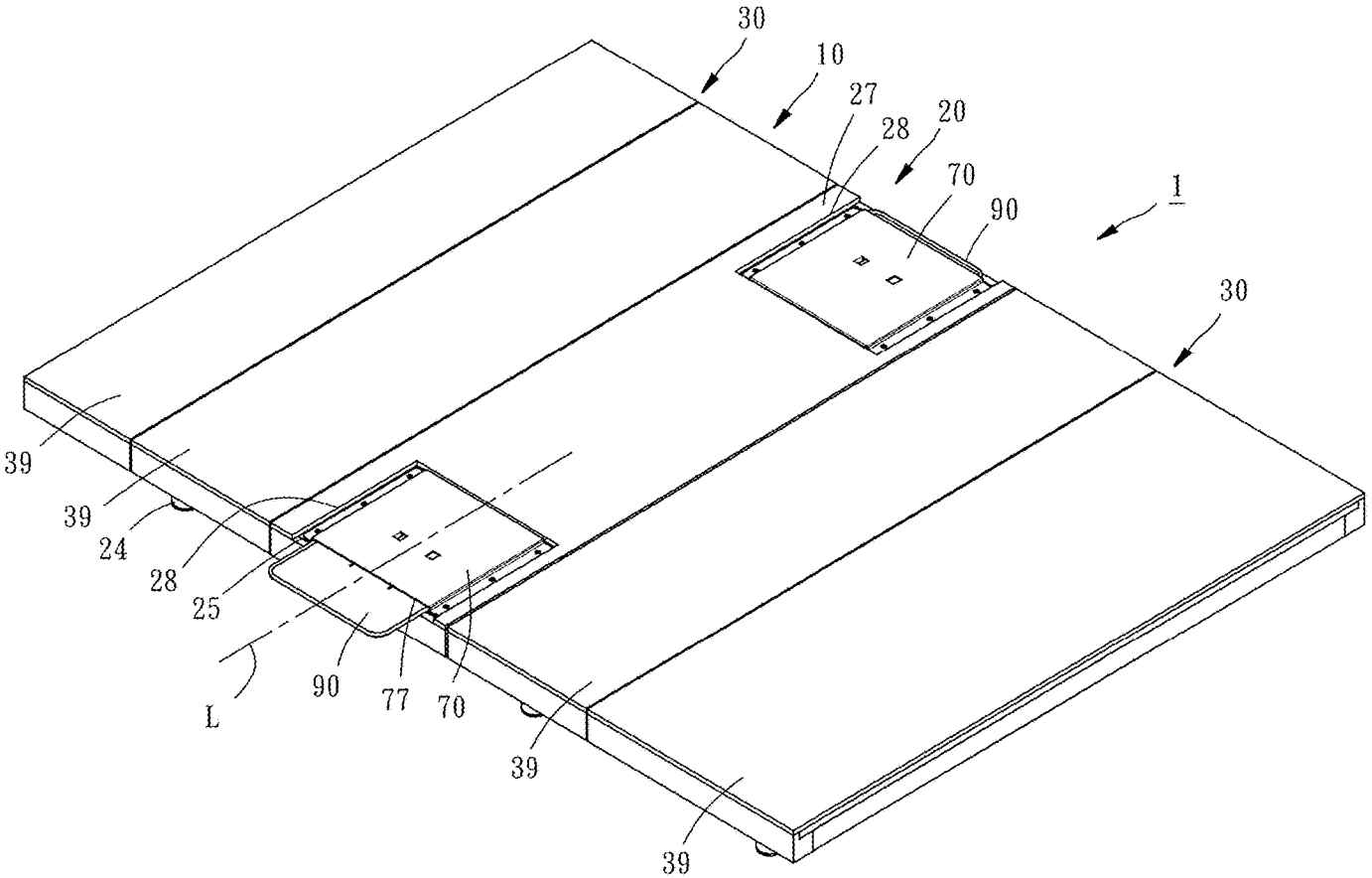
FIG. 1 is a perspective view of an electric bed according to a first preferred embodiment of the present invention.
Figure 2:
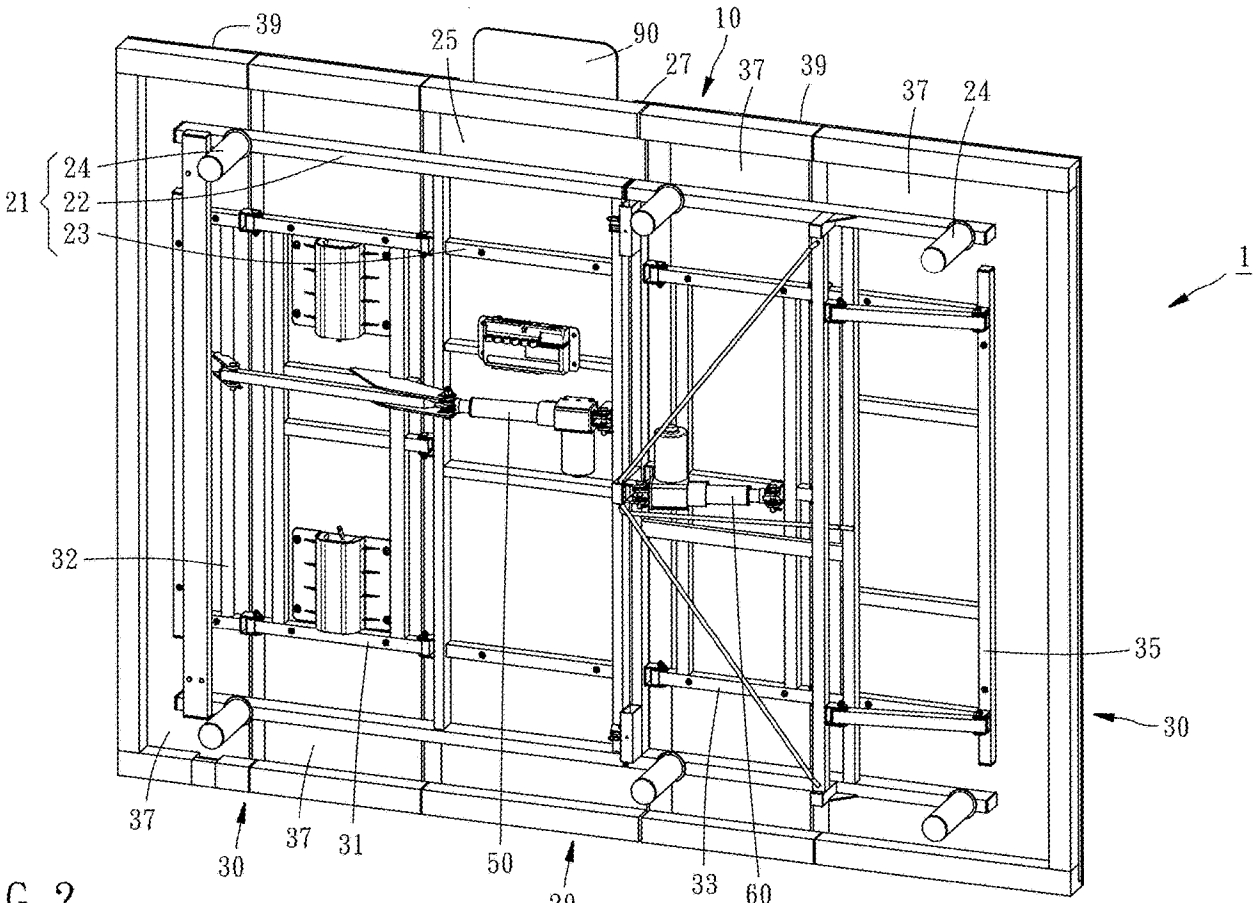
FIG. 2 is another perspective view of the electric bed according to the first preferred embodiment of the present invention.

Referring to FIGS. 1 and 2, an electric bed 1 according to a first preferred embodiment of the present invention includes a frame 10, a first actuator 50, a second actuator 60, two base bodies 70 and two plate members 90. The electric bed 1 is adapted for a mattress or a cushion (not shown) to be placed thereon.

The frame 10 includes a fixed rack 20 and two movable racks 30 movably disposed at the fixed rack 20.

The fixed rack 20 has a rack body 21 for being placed on the floor or other surfaces, a first supporting board 25 disposed at a top side of the rack body 21 corresponding to a position of user's hips, and a first cushion 27 disposed at the top side of the first supporting board 25. The rack body 21 includes a supporting rack 22, a hip rack 23 connected with the supporting rack 22 by two sides thereof and located at a bottom side of the first supporting board 25, and six leg posts 24 disposed at the bottom of the supporting rack 22. In addition, the first cushion 27 has two notches 28 located beside the user's hips.

The two movable racks 30 mean elements which can be swung or moved relative to the fixed rack 20. In this embodiment, the movable rack 30 on the left of FIG. 2 has a back rack 31 movably disposed at a front side of the hip rack 23 of the rack body 21, a head rack 32 movably disposed at a front side of the back rack 31, two second supporting boards 37 respectively disposed at top sides of the back rack 31 and the head rack 32, and two second cushions 39 respectively disposed at top sides of the two second supporting boards 37 corresponding to the back rack 31 and the head rack 32. The movable rack 30 on the right of FIG. 2 has a thigh rack 33 movably disposed at a rear side of the hip rack 23 of the rack body 21, a shank rack 35 movably disposed at a rear side of the thigh rack 33, two second supporting boards 37 respectively disposed at top sides of the thigh rack 33 and the shank rack 35, and two second cushions 39 respectively disposed at top sides of the two second supporting boards 37 corresponding to the thigh rack 33 and the shank rack 35. The back rack 31, the head rack 32, the thigh rack 33 and the shank rack 35 are located correspondingly to user's back, head, thighs, and shanks, respectively. The material of these first and second supporting boards 25 and 37 can be wood, melamine, etc. These first and second cushions 27 and 39 can be cushion object such as foam or mattress covered by the fabric. It should be noticed that, in other embodiments, the two movable racks 30 can be other rack bodies movable relative to the fixed rack 20, alternatively the hip rack 23 of the rack body 21, the back rack 31, the head rack 32, the thigh rack 33, the shank rack 35 and these first and second supporting boards 25 and 37 can be replaced by net rack, and the first and second cushions 27 and 39 can combine with the neighboring cushion.

Figure 3:
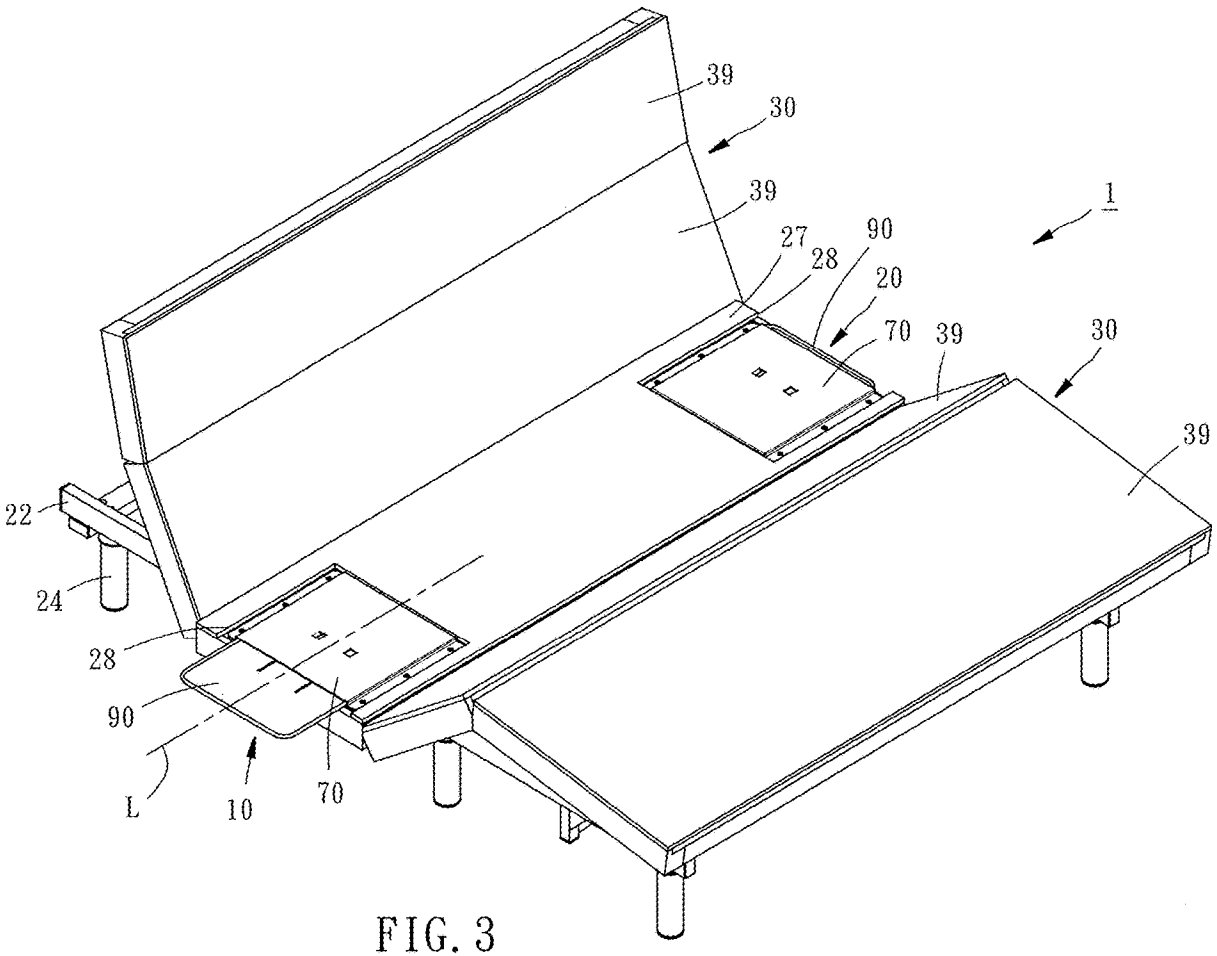
FIG. 3 is a perspective view of the electric bed according to the first preferred embodiment of the present invention, showing the function of the electric bed.

Referring to FIGS. 2 and 3, the first and second actuators 50 and 60 are disposed between the fixed rack 20 and the two movable racks 30, so that the two movable racks 30 are movable relative to the fixed rack 20. In this embodiment, the first actuator 50 has two ends which are rotatably connected with the hip rack 23 of the rack body 21 and the back rack 31, and the first actuator 50 can drive the back rack 31 to be swung relative to the fixed rack 20, so as to lift or lower user's back. The second actuator 60 has two ends which are rotatably connected with the hip rack 23 of the rack body 21 and the thigh rack 33, and the second actuator 60 can drive the thigh rack 33 to be swung relative to the fixed rack 20, so as to lift or lower user's thighs.

The two base bodies 70 is disposed at a top side of the frame 10, and the two plate member 90 are movable into and out of the two base bodies 90, respectively. There may be lots of embodiments of the two base bodies 70 and the two plate member 70, the following description would be focused on the present embodiment.

Figure 4:
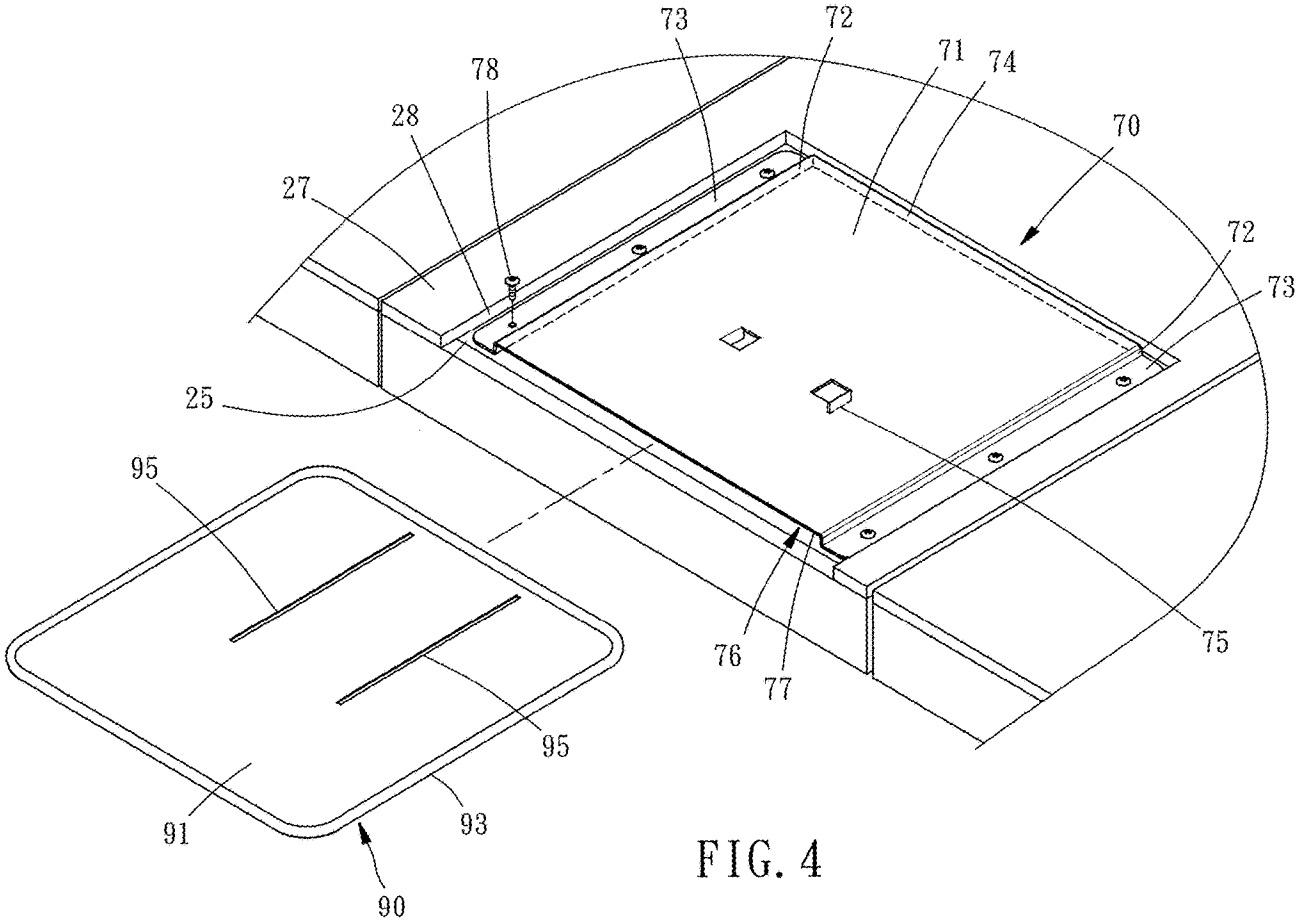
FIG. 4 is an exploded perspective view of a part of the electric bed of the first preferred embodiment of the present invention.

Referring to FIGS. 1 and 4, each of the base bodies 70 is disposed at a top side of the first supporting board 25 of the fixed rack 20 and located at the corresponding hollow portion 28. The base body 70 has a top plate 71, two side plates 72 extending downwardly from two sides of the top plate 71 respectively, two bottom plates 73 extending oppositely from bottom ends of the two side plates 72 respectively and fixed on the first supporting board 25 by screws 78, a blocking plate 74 extending downwardly from a side of the top plate 71, and two limiting portions 75 extending downwardly from the center of the top plate 71 and having a gap between each other. A part of the base body 70 (i.e. the top plate 71, the two side plates 72 and the blocking plate 74) and the frame 10 form an accommodating space 76 for accommodating one of the plate members 90. The accommodating space 76 has an opening 77 located at a side of the electric bed 1, and the blocking plate 74 is located at a side of the top plate 71 opposite to the opening 77. The two limiting portions 75 form integrally with the top plate 71, and each of the limiting portions 75 is formed by bending a part of the top plate 71 after cutting from the top plate 71. In addition, the tops of the base bodies 70 are flush with a top of the first cushion 27, so that the mattress or other cushion can be placed on the frame 10 firmly. In other embodiments, the first supporting board 25 has two hollow portions (not shown) for respectively disposing the base bodies 70 therein, and tops of the two base bodies 70 are flush with the top of the first supporting board 25, so that the mattress or other cushion can be directly placed on these first and second supporting boards 25 and 37, and the first and second cushions 27 and 39 can be omitted.

Each of the plate members 90 includes a bottom portion 91 and a protruded fringe 93 extending upwardly from a periphery of the bottom portion 91. The protruded fringe 93 forms integrally with the bottom portion 91, wherein the protruded fringe 93 extends upwardly from the bottom portion 91 and toward the center of the bottom portion 91 to form a curve shape. The bottom portion 91 has two elongated slots 95 extending along an imaginary line L, the limiting portions 75 extend through the elongated slots 95, so that the plate member 90 is movable relative to the base body 70 along the imaginary line L. The plate member 90 can extend from the accommodating space 76 via the opening 77 (as the plate member 90 on the bottom of FIG. 1). When the plate member 90 moves to a position where the two limiting portions 75 respectively abut against an end of the two elongated slots 95, the position of the plate member 90 is limited, and the plate member 90 would not move out of the accommodating space 76 anymore. On the other hand, the plate member 90 can move back into the accommodating space 76 (as the plate member 90 on the top of FIG. 1). When the plate member 90 moves to a position where the two limiting portions 75 respectively abut against other ends of the two elongated slot 95 and/or the plate member 90 abuts against the blocking plate 74 of the base body 70, the plate member 90 would not move anymore in the same direction.

Accordingly, when user wants to place things, he/she can just pull out any plate member 90 from the corresponding accommodating space 76, for example, grip and pull the protruded fringe 93 beside the opening 77, and the plate member 90 can be used as a table for placing the things thereon. In addition, the protruded fringe 93 of the plate member 90 has a certain height, so that things are not easy to roll down or fall down from the plate member 90. On the other hand, if user do not want to use the plate member 90, the plate member 90 can be moved back to the corresponding accommodating space 76, and the things with tolerable height (depending on the height of the protruded fringe 93) can be stored in the accommodating space 76. Because each of the plate members 90 would not exposed from the electric bed 1 when moving back to the corresponding accommodating space 76, user would not collide with the plate members 90 when the user moves around the electric bed 1, and the plate members 90 would not occupy space. In addition, the two plate members 90 are located beside user's hips, so that it's easy for user to pull out or push back the two plate members 90 and place or take the things.

Figure 5:
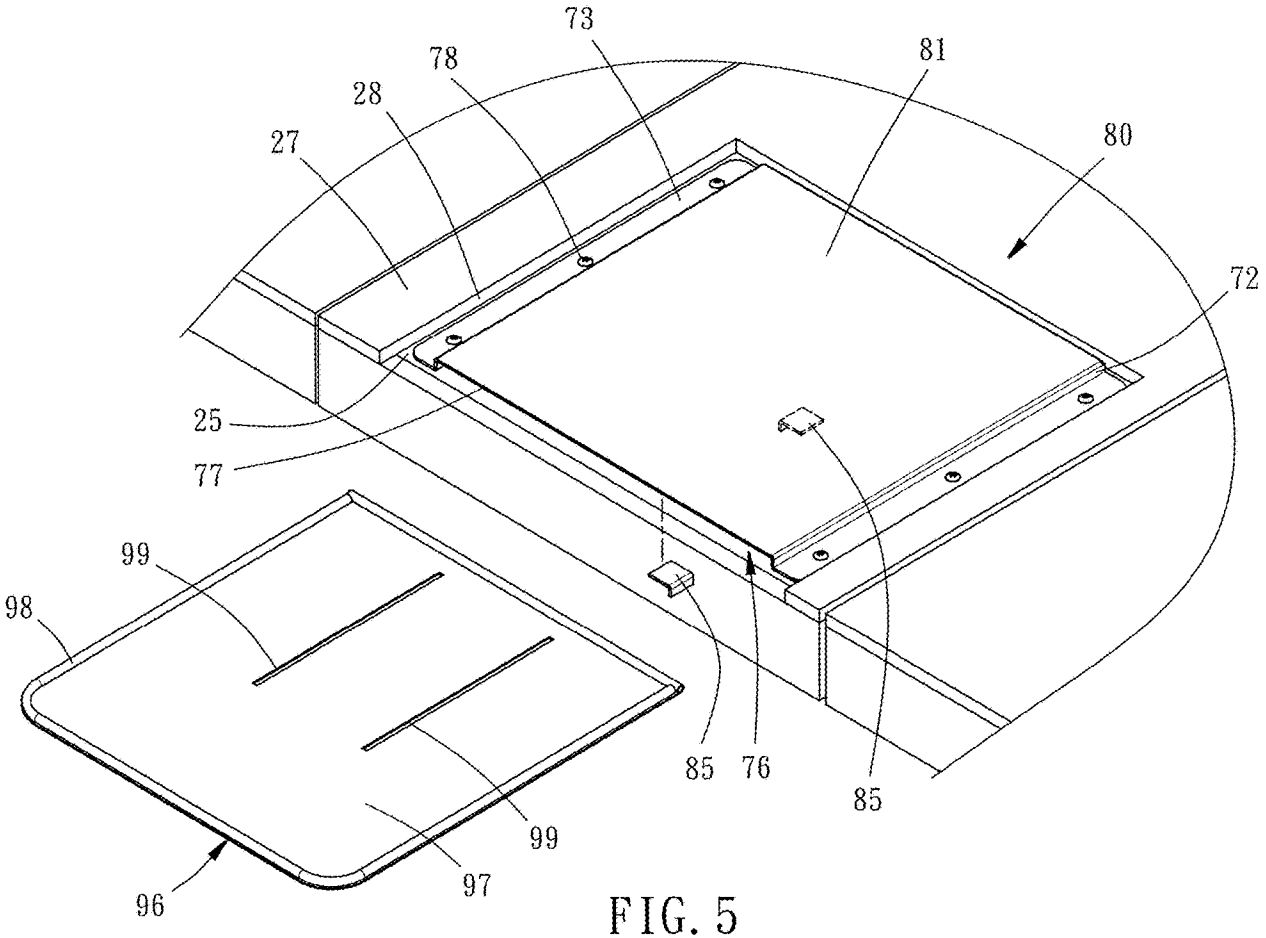
FIG. 5 is an exploded perspective view of a part of the electric bed of a second embodiment of the present invention.

The structures of the two base bodies 70 and the two plate members 90 can be modified. For example, referring to FIG. 5, it shows a base body 80 and a plate member 96 according to a second preferred embodiment of the present invention. The differences between the first and second preferred embodiments are, two L-shaped limiting members 85 are disposed at a bottom side of a top plate 81, a tubular handle 98 is disposed at a periphery of the bottom portion 97 of the plate member 96, and bottom ends of the two limiting members 85 extend into two elongated slots 99 of the bottom portion 97, respectively.

Besides, based on the spirit of the present invention, the shapes, locations and numbers of the two base bodies 70 and the two plate members 90 can be modified. For example, these base bodies 70 and plate members 90 can be disposed at any movable rack 30 (such as the thigh rack 33, and etc.), so that an extended second plate member can be used as a supporting frame for placing things such as tablets, books or newspapers thereon after the movable rack 30 is lifted. The frame 10 may not have these first and second supporting boards 25 and 37, and the two base bodies 70 can be directly disposed at a top side of the hip rack 23 of the rack body 21, the back rack 31, the head rack 32, the thigh rack 33 or the shank rack 35. The two base bodies 70 may not have the two limiting portions 75 or the blocking plate 74. The two base bodies 70 is not limited to the structure composed of the top plate 71, the two side plates 73, the two base plates 73 and the blocking plate 74. For example, any base body 70 has two slide rails (not shown) for moving the two plate members 90 along the two slide rails. The two limiting portions 75 and the two elongated slots 95 can be replaced by other limiting structures. The protruded fringes 93 of the two plate members 90 can be modified in shape or replaced by other side walls or handles, alternatively the protruded fringes 93 can be omitted.

The above description represents merely the preferred embodiment of the present invention, without any intention to limit the scope of the present invention. The simple variations and modifications not to be regarded as a departure from the spirit of the invention are intended to be included within the scope of the following claims.

What is claimed is:

1. An electric bed, comprising:

a frame, comprising a fixed rack and a movable rack movably disposed at the fixed rack;

an actuator, disposed between the fixed rack and the movable rack in a way that the movable rack is movable relative to the fixed rack;

a base body, disposed at a top side of the frame and provided with a top plate and two side plates extending downwardly from two sides of the top plate, respectively; and a plate member, movable into and out of the base body;

wherein the top plate of the base body, the two side plates of the base body and the frame form an accommodating space for accommodating the plate member; the accommodating space has an opening, through which the plate member is movable into or out of the accommodating space.

2. The electric bed as claimed in claim 1, wherein the base body comprises two bottom plates disposed at the frame and extending oppositely from bottom ends of the two side plates, respectively.

3. The electric bed as claimed in claim 2, wherein the base body has a limiting portion extending downwardly from the top plate; the plate member comprises an elongated slot extending along an imaginary line; the limiting portion extends through the elongated slot, so that the plate member is movable relative to the base body along the imaginary line.

4. The electric bed as claimed in claim 2, wherein the base body further comprises a blocking plate extending downwardly from a side of the top plate opposite to the opening.

5. The electric bed as claimed in claim 1, wherein the plate member comprises a bottom portion and a protruded fringe extending upwardly from a periphery of the bottom portion.

6. The electric bed as claimed in claim 1, wherein the fixed rack comprises a rack body and a first supporting board disposed at a top side of the rack body, and the base body is disposed at a top side of the first supporting board of the fixed rack.

7. The electric bed as claimed in claim 6, wherein the first supporting board has a hollow portion for disposing the base body therein.

8. The electric bed as claimed in claim 6, wherein the fixed rack further comprises a first cushion disposed at the top side of the first supporting board, the first cushion has a notch, in which the base body is located.

9. The electric bed as claimed in claim 8, wherein a top of the base body is flush with a top of the first cushion.

* * * * *